United States Patent [19]

Colli

[11] Patent Number: 4,856,268

[45] Date of Patent: Aug. 15, 1989

[54] UNWINDER ARM ROTATING ABOUT A PIVOT SUSPENDED ABOVE A TWO-FOR-ONE TWISTING SPINDLE FOR UNWINDING SUPERPOSED BOBBINS

[75] Inventor: Luigi Colli, Pordenone, Italy

[73] Assignee: Savio, S.p.A., Pordenone, Italy

[21] Appl. No.: 218,541

[22] Filed: Jul. 13, 1988

[30] Foreign Application Priority Data

Jul. 24, 1987 [IT] Italy ..... 21427 A/87

[51] Int. Cl.[4] ..... D01H 7/86; D01H 13/04; D01H 13/12

[52] U.S. Cl. ..... 57/58.52; 57/58.83; 57/352; 242/128

[58] Field of Search ..... 57/58.49–58.63, 57/58.83, 58.86, 352; 242/128

[56] References Cited

U.S. PATENT DOCUMENTS 3,623,312 11/1971 Gutbrod ..... 57/58.83
3,635,007 1/1972 Yoshida et al. ..... 57/58.52
3,742,693 7/1973 Greive et al. ..... 57/58.86
4,439,979 4/1984 Winkelmann ..... 57/58.52 X
4,469,290 9/1984 Frentzel-Beyme ..... 242/128
4,542,618 9/1985 Lossa ..... 57/58.83

*Primary Examiner*—John Petrakes
*Attorney, Agent, or Firm*—Hedman, Gibson, Costigan & Hoare

[57] ABSTRACT

This invention is a device for unwinding and guiding yarn from a feed bobbin located in a feed box. The device has an arm which is rotated by the tension of the unwinding yarn. More specifically, this invention is a device for unwinding and guiding yarn which has first unwinder arm rotating around the bobbin rotatably connected to a pivot positioned above the spindle head, and a second unwinder arm rotatably connected to the spindle for producing twisted yarn. The first unwinder arm is supported by a frame which is connected to the box containing the two superposed bobbins so as to allow the second unwinder arm to rotate within the rotatable trajectory of the first arm.

4 Claims, 2 Drawing Sheets

UNWINDER ARM ROTATING ABOUT A PIVOT SUSPENDED ABOVE A TWO-FOR-ONE TWISTING SPINDLE FOR UNWINDING SUPERPOSED BOBBINS

FIELD OF THE INVENTION

The invention is based on the presence of an unwinder arm rotating about a pivot suspended above the top of a spindle head and supported by one or more bars secured in a centered arrangement at their bottom by a forced fit or hinged connection to the upper edge of the containing box for the two superposed bobbins. The invention is applicable to a two-for-one twisting spindle for twisting together a number of yarns to form a twisted yarn assembly.

BACKGROUND OF THE INVENTION

These yarns can be of any composition or structure, the term "yarn" being used interchangeably in the description and claims given hereinafter to indicate both the feed to be twisted and the twisted product itself, and to include all natural or artificial filaments, filament assemblies or fibres. The term "twist together" is used here in the broadest sense of combining two or more yarns, and in this sense can include twisting together the ends of previously twisted yarns. Although the invention is particularly useful for twisting together two yarns it can be used for combining three or more yarns, the limit being dictated only by practical considerations.

It is well known that in a two-for-one twisting spindle the yarns to be twisted together are unwound upwards from at least two bobbins located on a fixed mandrel. This known unwinding operation has the drawback of causing the yarns to interfere with each other and become tangled before entering the central hole in the spindle, thus forming loops, rings, spiral corkscrew-shaped portions and shapes of this kind. It is also well known that the unwinding yarns in a two-for-one twister, especially of high-speed operation, are exposed to tension variation which is sometimes excessive. If several yarns are concerned, whether yarns spun from flock or synthetic filament yarns, this excessive tensioning is undesirable because the yarns undergo severe stressing and friction contact whenever they tangle during their continuous unwinding from the feed bobbins, and they consequently become excessively stretched, damaged or in the limit broken. This generates interruptions in the production process and therefore impairs the economics and productivity of plants of this kind.

Two-for-one twisting spindles of this construction have the further drawback that the yarn is caused to rest and slide on the outer peripheral surface of the feed bobbins, thus damaging the yarn by abrasion and reducing its strength. There is therefore the danger that this intersecting of the yarns, which as they unwind rotate in orbits about the spools, and the aforesaid sliding along the outer peripheral surfaces of the bobbins themselves, lead to the formation of flying dust and fibrils, which after a certain time become twisted together with the yarn and can result in twisting defects. Again, this repeated yarn intersection and obstruction and the said frequent sliding contact along the outer surfaces of the feed bobbins can result in a greater energy requirement per spindle and therefore an increased cost of the twisted yarn product. Many attempts have been made to ensure that the yarns unwinding from the bobbins mounted on the bobbin carrier coaxial with the hollow spindle do not undergo mutual interference and obstruction during their orbital unwinding rotation before penetrating into the open end of the spindle. Typical examples of these attempts of the known art are the unwinder arms positioned at the top of the spindle shank or in the middle between the superposed feed bobbins, or alternatively at the bottom below the unwinding bobbins.

The arms are entrained by the yarns and rotate about the spindle shank by being centered thereon, and for a considerable time have been used as an unwinding and guiding aid for the yarns to be twisted. In addition, discs or plates of various shapes are known which, centered and positioned horizontally about the spindle at its top or in the middle between the superposed bobbins, guide the yarns to be twisted by separating them from each other along the path between the unwinding zone and the top zone in which they enter the spindle.

The use of such yarn guides does not represent a satisfactory solution to the problem in the production of twisted yarns in two-for-one twisting spindles.

In this respect, these known-art applications frequently result in non-uniform twisting because of the variation in yarn tensioning conditions deriving from the different and intricate guiding of the individual unwinding yarns. This effect is undesirable because it ruins the appearance of the twisted yarn and also results in a reduction in its resistance to tear because the individual yarns when subjected to a pulling force undergo nonuniform loading. In the case of very thin yarns undergoing particularly rapid unwinding, this can result in breakage. In addition, the aforesaid known devices are rather complicated in their construction and application and are also rather difficult to use. They are in fact of more costly construction and more complicated to handle than the unwinder element of the present invention.

An object of the present invention is to obviate the aforesaid drawbacks by providing an unwinder arm for a two-for-one twisting spindle producing twisted yarn, which has the following advantges:

- it eliminates the formation of loops, rings and spiral corkscrew-shaped portions while maintaining the tension in the yarn unwinding from the feed bobbin substantially constant;
- it reduces breakages to a level substantially lower than any other known unwinder element, by making the yarn unwind in a more suitable manner;
- it enables any yarn structure, including cotton, to be twisted on a two-for-one twisting spindle operating by direct twisting, practially without regard to its composition or structure;
- it allows yarns unwinding from bobbins of considerable axial length and taking any unwinding path to be guided separately for twisting purposes; the limit depends only on the dimensional ability of the twister to hold the bobbins;

it enables the twister to use conical feed bobbins of any angle up to 5° 57° and also allows the twister to use two superposed bobbins with yarns of different fibre and of different count, because the braking of the unwinder element of the present invention, done by systems of the known art, is independent of the braking of any other unwinder elements which may be present. A further advantage of the unwinder element of the present invention, acting as an unwinding aid for the yarn which rotates it, is that it guides the yarn and enables it to run at the correct distance from other feed yarns, so that there is no possibility of the yarn guided by it intersection the other yarns, with the result that it does not rub against them and is therefore not subject to wear. This latter advantage enables a twisted yarn to be obtained which is of improved quality at lower operating cost. This improved quality derives from the lack of sliding contact between the individual yarns with consequently no generation of dust or flying fibrils, as the individual yarns take different paths during the entire unwinding stage. In this respect, the guide eye at the end of the unwinder arm of the present invention guides the yarn unwinding from the lower bobbin in an upper rotary orbit surrounding the rotary orbits of the other unwinding yarn or yarns.

In practice it is a substantial advantage if the unwinder arm of the present invention together with its support can be instantly mounted on the box containing the two or more superposed bobbins and can be likewise instantly removed, is said unwinder arms must be mountable and removable without effort. This can be done for example by providing the unwinder arm support at its bottom with a strip in the form of a circular band which can be elastically mounted on the upper edge of the bobbin box. Thus tools are not required either for mounting the unwinder element of the present invention on a two-for-one twisting spindle, or for removing it therefrom. Thus no constructional modification is necessary in order to be able to mount said unwinder element on an existing two-for-one twisting spindle.

SUMMARY OF THE INVENTION

These and further advantages are all attained according to the present invention by a yarn unwinder element, in particular for two-for-one twisting spindles for forming twisted yarn, characterised by comprising an unwinder arm which at one end rotates about a pivot located within the space between the top of the spindle head and the limiting eye for the balloon envelope formed by the twisted yarn, and at its other end terminates in an eye which guides the yarn unwinding from the lower bobbin so that it rotates within a space lying above and external to the trajectories taken by the other unwinding yarn or yarns. According to one embodiment, the unwinder arm pivot is held with its axis vertical by means of a hub supported by a frame having one or more bars which are elastically fitted at their bottom in a centered arrangement to the upper edge of the basket which contains the two or more superposed bobbins. The pivot axis when extended substantially coincides with the spindle axis.

According to a further embodiment the unwinder arm pivot is held with its axis vertical by a hub supported by a frame having at least one bar hinged at its bottom to the upper edge of the basket which contains the two or more superposed bobbins. Said pivot axis when extended substantially coincides with the spindle axis. The invention will be more apparent from the detailed description of embodiments thereof given hereinafter with reference to the two accompanying drawings, together with further clarification of its characteristics, it being however understood that the the invention is not limited to these embodiments alone.

BRIEF DESCRIPTION OF THE DRAWINGS

In the drawings.

In the figures, corresponding parts carry identical reference numerals for simplicity. Furthermore, in the figures those parts of known two-for-one twisting spindles not directly concerned with the invention are omitted for clarity.

DETAILED DESCRIPTION OF THE INVENTION

Figure 1:
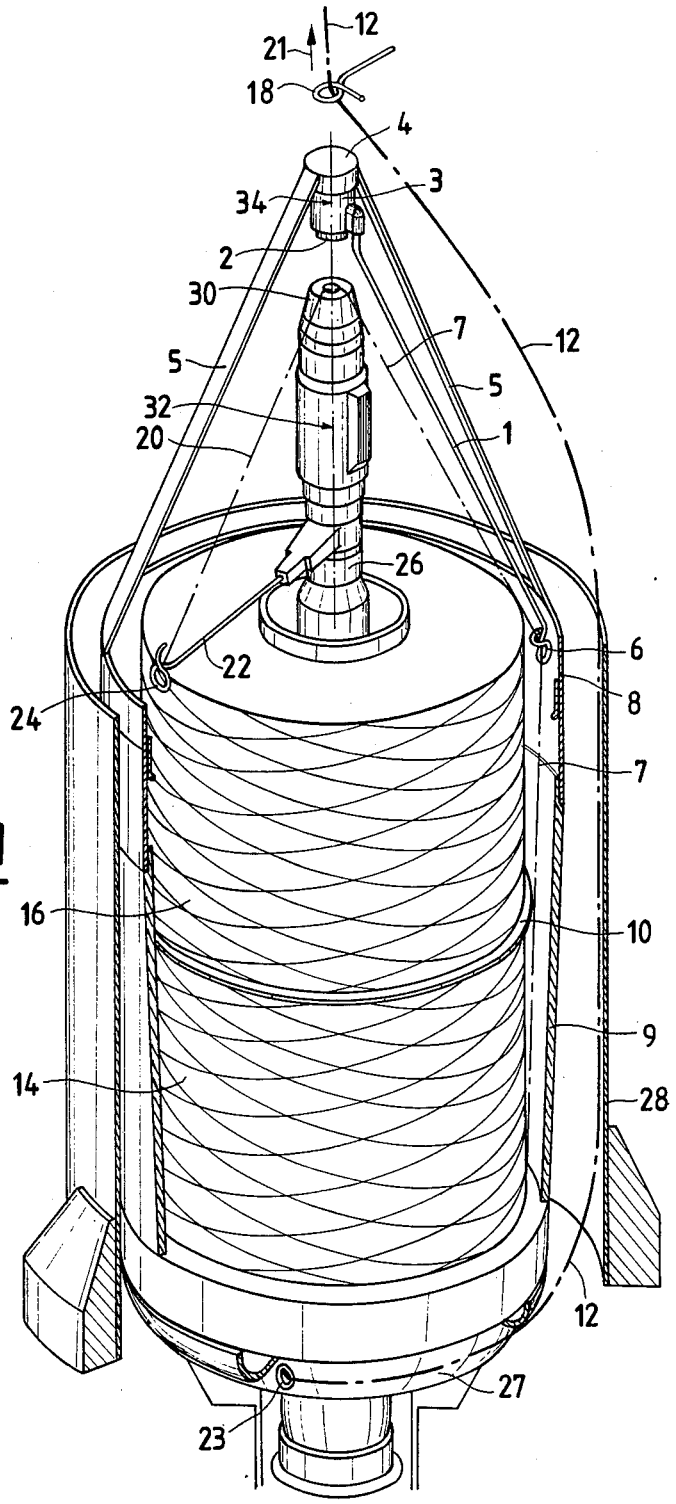
FIG. 1 is a diagrammatic partial axial section through a two-for-one twisting spindle with the associated unwinder arm, its rotation pin located vertically on the spindle axis and its support frame fitted elastically to the upper edge of the box which contains the two superposed bobbins.

In the two accompanying drawings: 1 is the unwinder arm rotated about the pivot 2 by the tension of the yarn 7, this latter being unwound from the lower bobbin 14. Said arm can be constructed of any material and have any shape provided that it is thin. It is however essential that the material is a light metal or non-metal, so that its final weight is small in order to give it the low inertia necessary for its rotary entrainment; 2 is the pivot located vertically above the spindle, and about which the unwinder arm 1 rotates idly; 3 is the rotating ring to which the unwinder arm 1 is connected; 4 is the fixed hub integral with the pivot 2 and used for its connection to the support frame 5 or 15; 5 is the frusto-conical frame with one or more bars which are connected at its bottom end to a strip in the form of a circular band or sector; 6 is the guide ring or eye for the yarn 7 located at the end of the unwinder arm 1. Its purpose is to ensure that the yarn slides with perfect ease, and it must be constructed of a wear-resistant material; 7 is the yarn unwinding from the lower bobbin and guided by the eye 6 of the unwinder arm 1; 8 is the strip in the form of a circular band or circular sector which is elastically fitted onto the upper edge of the bobbin carrying box 9; 9 is the box containing the superposed feed bobbins and is prevented from rotating by stop magnets orthe like (not shown); 10 is a thin intermediate disc which aids the guiding of the yarn 7 unwinding from the lower bobbin 14; 11 is the hinge which enables the unit comprising the frame and unwinder arm to be reclined to facilitate insertion of new superposed feed bobbins; 12 is the twisted yarn emerging radially from the yarn accumulation disc 27 through the duct 23 provided in the yarn accumulation disc itself. The twisted yarn 12 is then led upwards, forming a yarn balloon envelope, as far as a yarn guide eye 18 which defines the vertex of the balloon.

The twisted yarn 12 then continues its upward movement to feed the winding unit (not shown); 14 and 16 are the two superposed bobbins which feed the yarns to be twisted together in order to form twisted yarn 12; 20 is the yarn unwinding from the upper bobbin 16; 22 is an unwinder arm pivoted to rotate freely on the tubular shank 32 of the spindle by the action of the ring 26 which is entrained by the tension in the yarn 20. It is not however necessarily present; 24 is the guide ring or eye for the yarn 20 located at the end of the unwinder arm 22 and necessarily constructed of a material which resists the continuous sliding of any type of yarn; 21 is an arrow indicating the direction in which the twisted yarn 12 rises towards the winding unit; 28 is a circular housing which contains the balloon envelope formed by the twisted yarn 12; 30 is the head of the twisting spindle with a central hole for passage of the yarns to be twisted; 32 is the hollow shank of the spindle head which is substantially coincident and aligned with the axis 34 of the pivot 2 about which the unwinder arm 1 rotates; 15 is the support frame formed with a frusto-conical surface portion which acts as a support for the pivot 2 of the unwinder arm 1 and is connected lowerly to the hinge 11 so that it can be reclined together with the unwinder unit of the present invention; 15a is the position assumed by the frame 15 after being rotated about the pin of the hinge 11; 1*a*, 2*a* and 3*a* are the positions assumed repsectively by the elements 1, 2, 3 after they have been reclined, ie after being rotated about the pin of the hinge 11.

Figure 2:
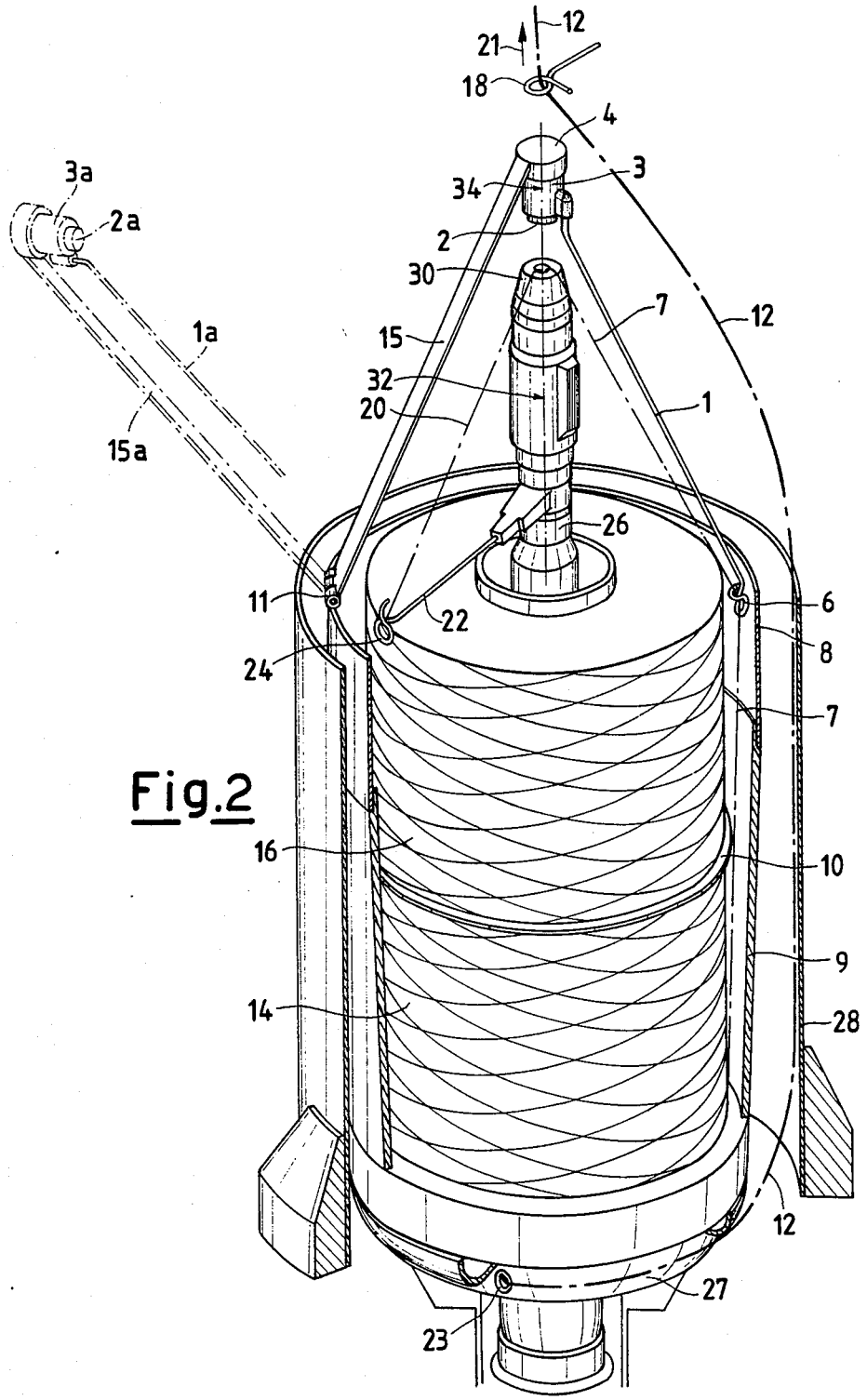
FIG. 2 is a diagrammatic partial axial section through a two-for-one twisting spindle with the associated unwinder arm, its rotation pin and its support frame hinged lowerly to the upper edge of the box which contains the two superposed bobbins, and also showing by dashed lines the position of the unit comprising the frame and unwinder arm when reclined so that it forms an angle to the spindle axis sufficient to give access to the superposed feed bobbins to enable them to be replaced.

The operation of the unwinder arm according to the present invention will now be described with reference to FIG. 1, Figure 2 showing an constructional configuration for which the operation is then easily derivable.

The feed bobbins 14 and 16 are superposed within the box 9 and are kept centered about the spindle shank 32.

The yarn 20 unwinding from the upper bobbin 16 is led upwards through the guide eye 24 of the unwinder arm 22 and is then inserted, together with the yarn 7 unwinding from the lower bobbin 14, through the hole in the head 30 of the hollow spindle shank 32. The yarns 7 and 20 are then withdrawn together radially from the yarn accumulation disc 27 through the duct 23 and are both led upwards within the annular space between the balloon container 28 and box 9. During this initial insertion, the yarn 7 is passed directly from the bobbin 14 to the inlet hole in the head 30. Having completed this stage of the insertion the unwinder arm 1 and its support frame 5 are mounted by elastically fitting this latter onto the upper edge of the box 9. With the unwinder arm 1 positioned as described, the yarn 7 is inserted into the ring 6 and the passage of the twisted yarn 12 formed from the yarns 7 and 20 twisted together is completed by inserting it through the yarn guide eye 18 which defines the vertex of the balloon envelope of the twisted yarn 12. The twisted yarn 12 then continues its path through the drawing rollers and yarn guide to be wound onto the bobbin under formation. The twisting spindle is now set in motion and the two yarns 7 and 20 forming the twisted yarn 12 are drawn though the central hole in the head 30 and unwind from the feed bobbins 14 and 16 totally independently of each other, ie without ever coming into mutual contact, as the action of the unwinder arm 1 and its guide eye 6 obliges them to describe surfaces of revolution which are different from each other and which never intersect.

It is apparent from the description that the two yarns 7 and 20 do not come into contact before entering the funnel-shaped entry hole in the head 30.

The yarn unwinder arm according to the invention, which is both simple and reliable in operation, can be applied with particular advantage to all typical twisted fibre assemblies such as worsted yarns, carded wool yarns, cotton yarns, cellulose wool and mixed yarns.

The device of the invention is suitable both for the direct twisting of two or more superposed bobbins and for use with a double bobbin from which with the aid of the unwinder arm according to the present invention the yarns are unwound and guided into the tubular shank of the spindle to obtain from the radial outlet of the accumulation disc a twisted yarn which is then led upwards to the winding unit.

A preferred embodiment has been described herein. It is however apparent that modifications to aid winding can be made thereto which fall within the scope of the present invention. Thus the positions of the guide eyes 24 and 6 can be different from those proposed, for example both can be dispoed within the annular space between the bobbin 16 and box 9, or can be disposed at different heights, for example the eye 6 in a higher position than the eye 24 or vice versa. The frame 5 can be modified in terms of shape and size and can consist of support bars of any number and shape, which can for example be in the form of lateral surface portions pertaining to solids of revolution. The rotary ring 3 can be replaced by any device which allows rotation about an axis substantially parallel and coincident with the axis of the spindle 32. Again, only the unwinder arm 1 of the present invention could be provided, supported by any of the described methods illustrated on the accompanying drawings. Modifications of an applicational nature could also be made. Thus, the hinge 11 could be replaced by a similar element. In addition, all parts can be replaced by others which are technically equivalent, but without leaving the scope of the inventive idea as defined in the claims given hereinafter.

Relative terminology such as "upper" and "lower" etc. is used in the description and/or claims only to describe the relation of certain elements to others when the twisting spindle is in its normal upright position, and must not be interpreted as limiting the elements of the invention to this precise position.

I claim:

1. A two-for one spindle assembly for producing twisted yarn from at least two separate yarn sources, comprising;

(a) a rotatable spindle having an opening in its top for receiving the separate yarns and a bottom end for emitting the twisted yarn;

(b) a pair of superposed upper and lower feed bobbins having an orifice through which said spindle passes, wherein each of said bobbins is adapted to supply yarn to said opening in said spindle;

(c) a pivot positioned above said spindle opening;

(d) a first unwinder arm rotatable about said spindle and rotatably connected at one end to said pivot, and having at its other end an eyelet through which yarn from said lower bobbin passes as it is fed to said spindle opening and while said eyelet rotates about said spindle; and (e) a second unwinder arm rotatably connected at one end to said spindle and having at its other end an eyelet positioned within the rotatable trajectory of said first arm eyelet and through which yarn from said upper bobbin passes as it is fed to said spindle opening and while said second arm eyelet rotates about said spindle.

2. The device of claim 1, further comprising a guide eye positioned above said pivot through which the twisted yarn is fed from said spindle bottom.

3. The device of claim 1, further comprising a bobbin box about said bobbins and a frame including a strip elastically fitted to said box, at least one bar connected at one end to said strip and connected at its other end to said pivot, and wherein said frame is readily removable from said box by virtue of said elastic fit for facilitating the changing operation of the bobbins.

4. The device of claim 1, further comprising a bobbin box about said bobbins and a frame including a bar connected by a hinge to said box and connected at its other end to said pivot, and wherein said frame rotates about said hinge for facilitating the changing operation of the bobbins.

* * * * *